US007748904B2

(12) United States Patent
Henn et al.

(10) Patent No.: US 7,748,904 B2
(45) Date of Patent: Jul. 6, 2010

(54) MULTICOMPARTMENT EVACUABLE STORAGE BAG

(75) Inventors: Steven M. Henn, Hawthorn Woods, IL (US); Donald L. Crevier, Essex, IL (US)

(73) Assignee: Illinois Tool Works Inc., Glenview, IL (US)

( * ) Notice: Subject to any disclaimer, the term of this patent is extended or adjusted under 35 U.S.C. 154(b) by 1455 days.

(21) Appl. No.: 11/127,643

(22) Filed: May 12, 2005

(65) Prior Publication Data

US 2006/0257054 A1 Nov. 16, 2006

(51) Int. Cl.

| | |
|---|---|
| ***B65D 30/22*** | (2006.01) |
| ***B65D 33/16*** | (2006.01) |
| ***B65D 33/01*** | (2006.01) |
| ***B65D 81/20*** | (2006.01) |

(52) U.S. Cl. ..... 383/38; 383/63; 383/103; 206/524.8

(58) Field of Classification Search ..... 383/38, 383/63, 100, 37, 103, 41, 43, 44, 45, 105, 383/39, 40, 101; 150/112, 117; 206/522, 206/524.8

See application file for complete search history.

(56) References Cited

U.S. PATENT DOCUMENTS

| | | | | |
|---|---|---|---|---|
| 2,063,850 | A * | 12/1936 | Nemeth et al. | 150/117 |
| 3,207,420 | A * | 9/1965 | Navarrete-Kindelan | 383/38 |
| 3,490,576 | A * | 1/1970 | Alessi et al. | 206/749 |
| 4,449,243 | A * | 5/1984 | Platel | 383/103 |
| 5,024,536 | A * | 6/1991 | Hill | 383/38 |
| 5,540,500 | A * | 7/1996 | Tanaka | 383/100 |
| 5,584,409 | A * | 12/1996 | Chemberlen | 383/103 |
| 5,701,996 | A * | 12/1997 | Goto et al. | 383/100 |
| 6,059,457 | A | 5/2000 | Sprehe et al. | |
| 6,116,781 | A | 9/2000 | Skeens et al. | |
| 6,595,689 | B1 * | 7/2003 | Borchardt et al. | 383/64 |
| 6,702,461 | B2 * | 3/2004 | Vangedal-Nielsen | 383/38 |
| 6,729,473 | B2 * | 5/2004 | Anderson | 383/100 |
| 6,752,264 | B2 * | 6/2004 | Versluys | 206/219 |
| 7,448,803 | B2 * | 11/2008 | Ootsubo | 383/100 |
| 7,674,041 | B2 * | 3/2010 | Frayne | 383/101 |
| 2002/0067865 | A1 | 6/2002 | Stutzman | |
| 2004/0000502 | A1 * | 1/2004 | Shah et al. | 206/524.8 |
| 2004/0050745 | A1 * | 3/2004 | Lee et al. | 206/524.8 |
| 2004/0057636 | A1 * | 3/2004 | Ishizaki | 383/63 |
| 2004/0114837 | A1 * | 6/2004 | Koyanagi | 383/103 |
| 2008/0107781 | A1 * | 5/2008 | Carroll | 426/128 |
| 2008/0159660 | A1 * | 7/2008 | Roell, III | 383/40 |

FOREIGN PATENT DOCUMENTS

| | | | |
|---|---|---|---|
| EP | 0683105 | A1 | 11/2005 |
| JP | 06092361 | A * | 4/1994 |

* cited by examiner

*Primary Examiner*—Jes F Pascua
(74) *Attorney, Agent, or Firm*—Ostrager Chong Flaherty & Broitman P.C.

(57) ABSTRACT

Storage bags having two or more evacuable reclosable compartments. Each compartment can be opened (to allow an article or goods to be placed inside), hermetically sealed, and then evacuated without disturbing the vacuum in the other compartment(s). Each compartment has a respective zipper that provides a hermetic seal and a respective valve through which air is exhausted from the compartment interior.

10 Claims, 8 Drawing Sheets

MULTICOMPARTMENT EVACUABLE STORAGE BAG

BACKGROUND OF THE INVENTION

This invention generally relates to reclosable bags. In particular, the invention relates to evacuable reclosable storage bags (the terms "evacuable storage bag" and "vacuum storage bag" will be used interchangeably hereinafter).

Collapsible, evacuable storage bags typically include a flexible, airtight receptacle having a mouth through which an article or goods can be inserted, an extruded plastic zipper for closing the mouth and hermetically sealing the receptacle, and a fixture (such as a one-way valve) through which excess air is evacuated from the bag. A user opens the zipper, places an article or goods into the open receptacle, closes the zipper, thereby hermetically sealing the receptacle, and then evacuates the air in the receptacle through the fixture. With the storage bag thus evacuated, a compressible article contained therein may be significantly compressed so that it is easier to transport and requires substantially less storage space.

Collapsible, evacuable storage bags are beneficial for reasons in addition to those associated with compression of the stored article. For example, removal of the air from the storage bag inhibits the growth of destructive organisms, such as moths, silverfish, and bacteria, which require oxygen to survive and propagate. Moreover, such bags, being impervious to moisture, inhibit the growth of mildew.

Not only large, compressible items such as clothing may be stored in collapsible, evacuable storage bags. For example, it may be desirable to store bulk items made of small particles, such as powders or granulated resins, in an evacuated bag. One situation that commonly occurs is that a particular bulk item is shipped in a large, rigid bag such as a drum. Bulk items may be moisture sensitive and are sealed against moisture during shipment. But many times a user does not need to use the entire contents of the large bag, and so once exposed to air the remaining bulk contents quickly become unusable and are thus wasted.

There is a continuing need for improvements in flexible, evacuable, reclosable storage bags.

BRIEF DESCRIPTION OF THE INVENTION

The present invention is directed to storage bags having two or more evacuable reclosable compartments. Each compartment can be opened (to allow an article or goods to be placed inside), hermetically sealed, and then evacuated without disturbing the vacuum in the other compartment(s). Each compartment comprises a respective zipper that provides a hermetic seal and a respective valve through which air is exhausted from the compartment interior. The bag can be provided with means for hanging in a closet. Alternatively, the bag can be folded for storage in a drawer or other container. A two-compartment bag can be provided with a handle in the center for travel and carry-on and can be used like saddlebags. The present invention is further directed to methods of manufacturing the storage bags disclosed herein.

One aspect of the invention is a storage bag comprising a first receptacle having an interior volume and a mouth, a first zipper that hermetically seals the mouth of the first receptacle when the first zipper closed, a second receptacle having an interior volume and a mouth, and a second zipper that hermetically seals the mouth of the second receptacle when the second zipper closed, wherein the first and second receptacles are connected, and the first and second zippers are disposed at opposite ends of the storage bag when the storage bag is arranged such that the first and second receptacles lie in the same plane with no fold therebetween, further comprising configurable means for exhausting air out of the first and second receptacles, the air exhausting means having a first configuration wherein air can be exhausted out of the first receptacle without affecting the amount of air in the second receptacle and having a second configuration wherein air can be exhausted out of the second receptacle without affecting the amount of air in the first receptacle.

Another aspect of the invention is a storage bag comprising first and second reclosable, evacuable compartments connected along a common side, wherein: the first compartment comprises a first receptacle having an interior volume and a mouth, a first zipper that hermetically seals the mouth of the first receptacle when the first zipper closed, and a first one-way valve for evacuating the interior volume of the first receptacle when the first zipper is closed; the second compartment comprises a second receptacle having an interior volume and a mouth, a second zipper that hermetically seals the mouth of the second receptacle when the second zipper closed, and a second one-way valve for evacuating the interior volume of the second receptacle when the second zipper is closed; and the common side comprises a band-shaped hermetic cross seal that prevents air inside the interior volume of one of the first and second receptacles from entering the interior volume of the other of the first and second receptacles.

A further aspect of the invention is a storage bag comprising first and second reclosable, evacuable compartments connected by an intermediate structure, wherein: the first compartment comprises a first receptacle having an interior volume and a mouth, and a first zipper that hermetically seals the mouth of the first receptacle when the first zipper closed; the second compartment comprises a second receptacle having an interior volume and a mouth, and a second zipper that hermetically seals the mouth of the second receptacle when the second zipper closed; and the intermediate structure comprises a valve outlet, a first collapsible valve that allows flow communication between the interior volume of the first receptacle and the valve outlet when the first collapsible valve is not collapsed, and a second collapsible valve that allows flow communication between the interior volume of the second receptacle and the valve outlet when the second collapsible valve is not collapsed.

Yet another aspect of the invention is a method of manufacture comprising the following steps: (a) arranging first and second webs of bag making material, first and second zipper tapes, and first and second valves strip such that the first and second webs of bag making material are in overlapping relationship with the first and second zipper tapes and the first and second valve strips arranged in parallel therebetween, with the second valve strip overlapping the first valve strip and the overlapping first and second valve strips being between the first and second zipper tapes, wherein the first zipper tape comprises a first pair of interlocked zipper strips and the second zipper tape comprises a second pair of interlocked zipper strips; (b) joining one zipper strip of each of the first and second zipper tapes to the first web and joining the other zipper strip of each of the first and second zipper tapes to the second web, the zipper strips being joined along their full length; (c) in first and second band-shaped zones of joinder that each extend from the first zipper tape to the second zipper tape, joining the first and second webs to each other in sections where the valve strips are absent and joining the first and second webs and the first and second valve strips together in sections where the valve strips are present; (d) joining the first and second webs and the first and second valve strips together in third through sixth band-shaped zones of joinder that each extend along a major portion of the distance separating the first and second band-shaped zones of joinder; (e) joining the first web to the first valve strip in seventh and eighth band-shaped zones of joinder that each extend along a minor portion of the distance separating the first and second band-shaped zones of joinder; and (f) joining the second web to the second valve strip in ninth and tenth band-shaped zones of joinder that each extend along a minor portion of the distance separating the first and second band-shaped zones of joinder. After steps (a) through (f) have been fully performed, the following structural relationships exist: (i) the third and sixth band-shaped zones of joinder are contiguous with the first band-shaped zone of joinder and extend toward, but do not meet the second band-shaped zone of joinder; (ii) the fourth and fifth band-shaped zones of joinder are contiguous with the second band-shaped zone of joinder and extend toward but do not meet the first band-shaped zone of joinder; (iii) the ninth band-shaped zone of joinder overlaps the seventh band-shaped zone of joinder, and the tenth band-shaped zone of joinder overlaps the eighth band-shaped zone of joinder (iv) the seventh and ninth band-shaped zones of joinder are contiguous with the second and third band-shaped zones of joinder; and collinear with the third band-shaped zone of joinder such that the first web is joined to the first valve strip and the second web is joined to the second valve strip along a first line that extends from the first band-shaped zone of joinder to the second band-shaped zone of joinder; and (v) the eighth and tenth band-shaped zones of joinder are contiguous with the second and sixth band-shaped zones of joinder; and collinear with the sixth band-shaped zone of joinder such that the first web is joined to the first valve strip and the second web is joined to the second valve strip along a second line that extends from the first band-shaped zone of joinder to the second band-shaped zone of joinder.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
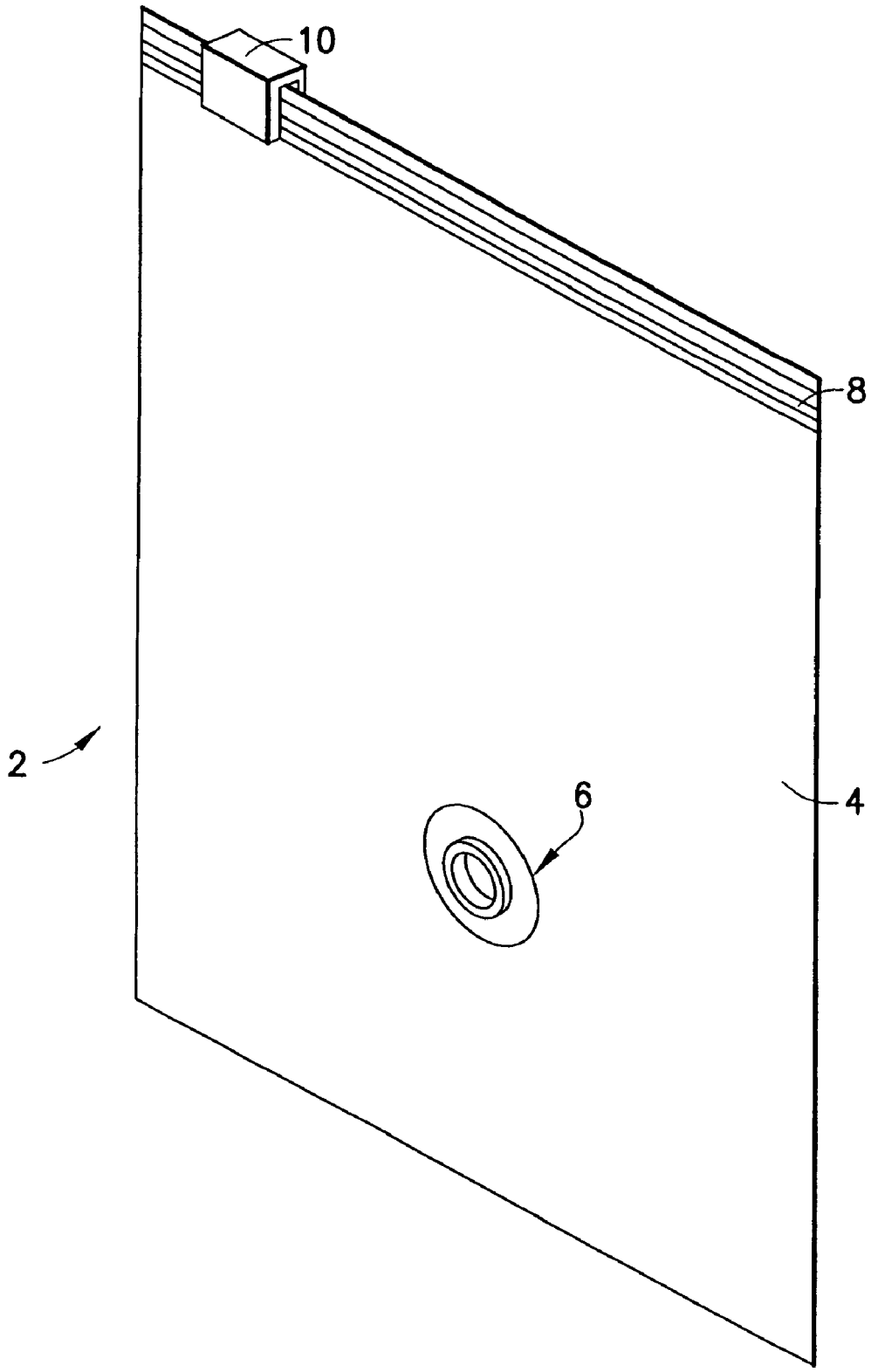
FIG. 1 PRIOR ART
FIG. 1 is a drawing showing an isometric view of one conventional type of collapsible, evacuable storage bag having a zipper and a slider for closing the zipper.

FIG. 1 shows a conventional collapsible, evacuable storage bag 2 having a single compartment. The storage bag shown in FIG. 1 comprises a bag 4, a valve assembly 6, and a zipper 8. The walls of the bag may be formed of various types of gas-impermeable thermoplastic material. The preferred gas-impermeable thermoplastics are nylon, polyester, polyvinyl dichloride and ethylene vinyl alcohol. For example, the bag making material may comprise a blended extrusion layer of polyethylene sandwiched between a nylon layer and a layer of polyethylene sheeting. However, the materials comprising the bag may be altered so as to prevent interaction with the bag contents.

One wall of bag 4 has a hole (not shown in FIG. 1) in which to install the valve assembly 6. The valve assembly 6 typically comprises a cap that can be snapped onto a portion of the valve assembly that is disposed on the exterior of the bag 4. The cap must be removed before the bag can be evacuated, and then is replaced after the bag has been evacuated. The cap is intended to seal the valve assembly to prevent air from entering the evacuated bag. The zipper 8 comprises a pair of mutually interlockable extruded zipper strips that are joined to each other at opposing ends thereof and that form a hermetic seal when the zipper is closed.

During use, one or more discrete articles or a bulk material (not shown) may be placed inside the bag 4 while the zipper 8 is open, i.e., while the closure profiles of the interlockable zipper strips are disengaged from each other. After the article or material to be stored has been placed inside the bag, the mouth of the bag 4 can be sealed by pressing the zipper strips together to cause their respective closure profiles to interlock with each other. The zipper strips can be pressed together using a device 10 commonly referred to as a "slider" or "clip", which straddles the zipper. The typical slider has a generally U-shaped profile, with respective legs disposed on opposing sides of the zipper. The gap between the slider legs is small enough that the zipper can pass through the slider gap only if the zipper is in a closed state. Thus when the slider is moved along an open zipper, this has the effect of pressing the incoming sections of the zipper strips together. The zipper is opened by pulling apart the zipper upper flanges, as explained in more detail below. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

The zipper 8 comprises a pair of mutually interlockable zipper strips made of extruded thermoplastic material, each zipper strip having a respective generally constant profile along the interlockable portion of the zipper. The ends of the zipper strips are joined together at the sides of the bag, e.g., by the application of heat and pressure, which typically involves crushing of the zipper profiles. The zipper 8 is designed to form a hermetic seal at the mouth of the bag 4 when the zipper 8 closed. After the zipper has been closed, the interior volume of the bag can be evacuated by sucking air out via the one-way valve assembly 6. Air can be drawn out of bag 4 through valve assembly 6 using a conventional vacuum source, such as a household or industrial vacuum cleaner. The valve assembly 6 and the zipper 8 maintain the vacuum inside bag 4 after the vacuum source is removed.

The various embodiments of the invention improve upon the type of bag shown in FIG. 1 by providing multiple compartments. However, the disclosed embodiments may incorporate the same type of zippers and sliders and the same type of bag making material as those utilized in the bag seen in FIG. 1. One embodiment to be disclosed (shown in FIG. 2) also includes the same type of valve assemblies.

Figure 2:
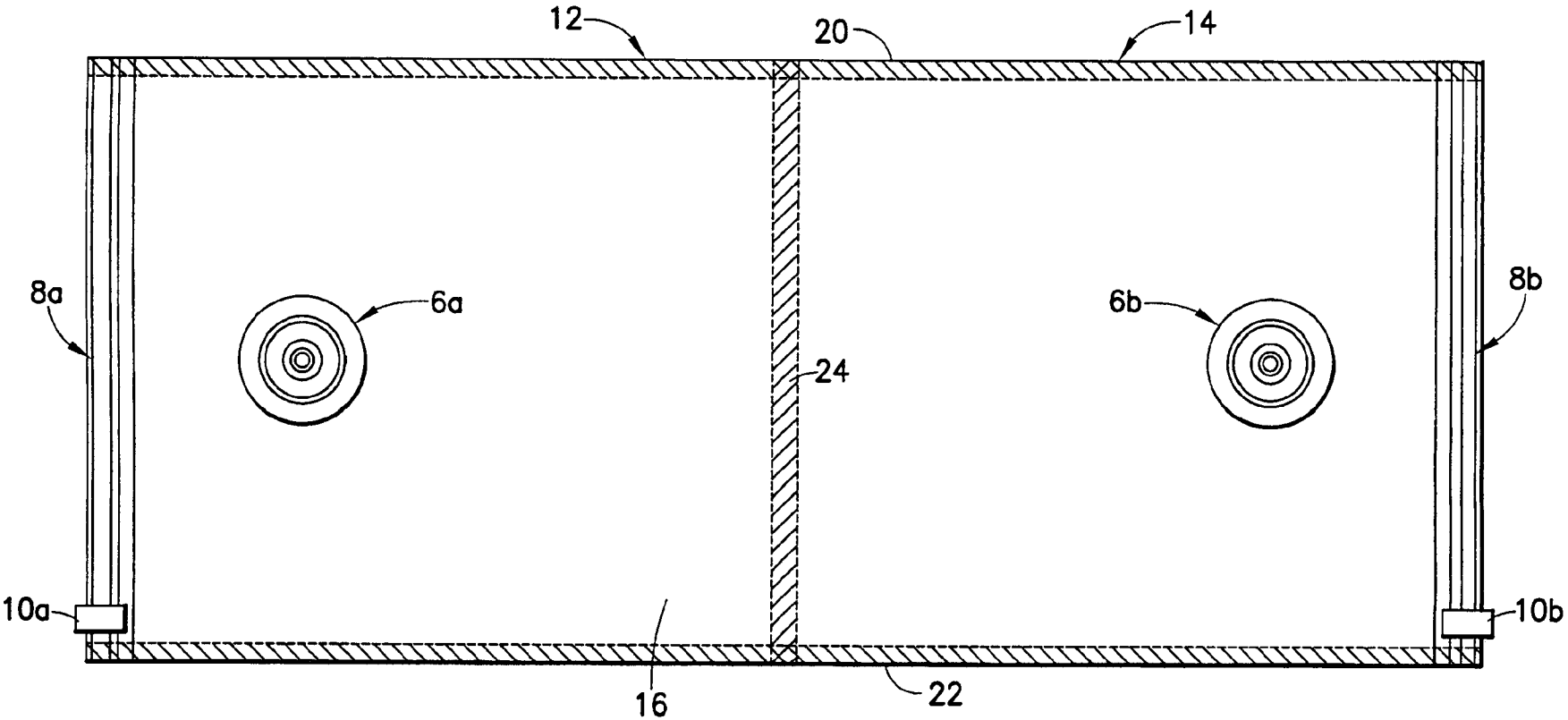
FIG. 2 is a drawing showing a top view of a two-compartment vacuum storage bag in accordance with a first embodiment of the invention.

In accordance with one embodiment of the present invention, two evacuable compartments are connected at their bottoms in saddlebag fashion to form a two-compartment storage bag. FIG. 2 is a top view of such a two-compartment storage bag, the two compartments being respectively designated by numerals 12 and 14. This two-compartment storage bag comprises a front wall 16 and a rear wall (not visible in FIG. 2 because it is directly under the front wall 16 when viewed from above), each wall comprising a respective rectangular sheet of a thin flexible bag making material. A first side seam 20 runs along one side of the two-compartment bag, while a second seam 22 runs parallel to the first side seam and along the other side of the two-compartment bag (the side seams 20 and 22 are indicated by hatching in FIG. 2). The front and rear walls are joined together (e.g., by conventional conduction heat sealing) at the side seams 20 and 22. The front and rear walls are also joined together in a band-shaped zone 24 whose centerline is at or near the midline of the rectangular bag walls (hereinafter "central seal 24"). The central seal 24 extends from one side seam to the other side seam, thereby separating and sealing off the interior volumes of compartments 12 and 14 from each other and forming a common third side for the connected rectangular compartments.

The fourth side of compartment 12 has a zipper 8*a* installed at one end of the two-compartment bag between marginal portions of the front and rear bag walls, while the fourth side of compartment 14 has a zipper 8*b* installed at the other end of the two-compartment bag between marginal portions of the front and rear bag walls. These marginal portions of the front and rear walls are respectively sealed to the zipper strips by lengthwise conduction heat sealing in conventional manner. Alternatively, the interlockable zipper strips can be attached to the wall panels by adhesive or bonding strips or the zipper profiles can be extruded integrally with the bag material.

Zippers 8*a* and 8*b* are identical in construction and preferably have interlockable closure profiles that form a hermetic seal when interlocked. Instead of designing the closure profiles of the zipper to form a hermetic seal when interlocked, alternative means (e.g., a layer of pressure sensitive adhesive material or two layers of cohesive material) for hermetically sealing the interface between the interlocked zipper strips may be provided on the zipper.

A person may store goods in either compartment of the storage bag depicted in FIG. 2. For example, the zipper 8*a* can be opened by the user to provide access to the interior volume of compartment 12. An article or goods to be stored are then placed inside compartment 12 and the zipper 8*a* is reclosed, e.g., by moving a slider 10*a* along the entire length of the zipper 8*a*. The interior volume of compartment 12 can then be evacuated by sucking the interior air out through a first one-way valve assembly 6*a*, which in the embodiment depicted in FIG. 2 penetrates the front wall 16. Independent of the state of compartment 12, the zipper 8*b* can be opened by the user to provide access to the interior volume of compartment 14. An article or goods to be stored are then placed inside compartment 14 and the zipper 8*b* is reclosed, e.g., by moving a slider 10*b* along the entire length of the zipper 8*b*. The interior volume of compartment 14 can then be evacuated by sucking the interior air out through a second one-way valve assembly 6*b* that penetrates the front wall 16. Because the evacuated interior volumes of the compartments 12 and 14 are separated by the central seal 24 and do not communicate with each other, either compartment can be opened without affecting the vacuum inside the other compartment.

Figure 3:
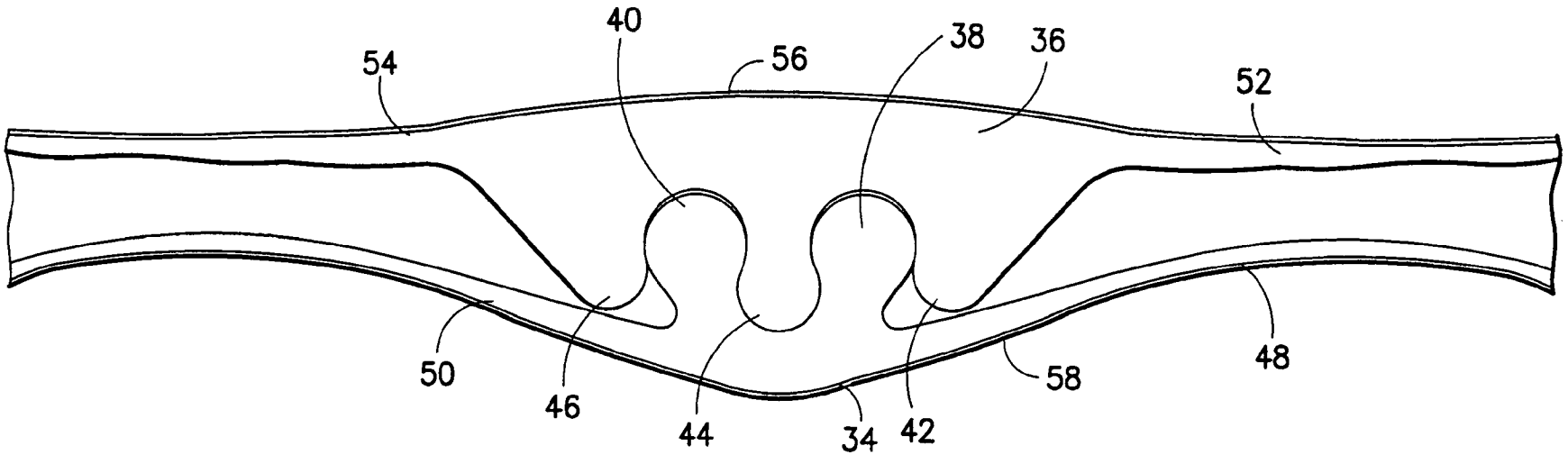
FIG. 3 is a drawing showing a cross-sectional view of a known zipper suitable for use in the various embodiments of the invention disclosed herein.

One type of zipper suitable for use in the two-compartment bag seen in FIG. 2 (and the other embodiments of the invention disclosed below) will now be described with reference to FIG. 3. As seen in FIG. 3, the zipper 8 comprises a pair of mutually interlockable extruded zipper strips 34 and 36. The zipper strip 34 comprises a pair of projections 38 and 40 having ball-shaped closure profiles, an upper flange 48, and a lower flange 50. The zipper strip 36 comprises a trio of projections 42, 44 and 46 having ball-shaped closure profiles, an upper flange 52, and a lower flange 54. For each zipper strip, the portions exclusive of the projections will be referred to herein as a "base". The bag walls may be joined to the respective bases of the zipper strips by conduction heat sealing across their entire height or across only portions thereof. For example, the bag walls 56 and 58 could be joined to the zipper lower flanges and to the upper flanges by means of conduction heat sealing, as shown in FIG. 3.

Still referring to FIG. 3, the projections 38 and 40 interlock with projections 42, 44 and 46 by fitting inside the respective spaces therebetween. The upper flanges 48 and 52 can be gripped by the user and pulled apart to open the closed zipper. The opened zipper can be reclosed by pressing the zipper strips together (e.g., using a slider) along the entire length of the zipper with sufficient force to cause the projections 38 and 40 to enter the respective spaces between the projections 42, 44 and 46. Typically, such a slider takes the form of a U-shaped clip that fits over the zipper with clearance for the upper flanges of the zipper, while the legs of the clip cam the zipper profiles of the incoming zipper section into engagement when the slider is moved along the zipper in either direction. The opposing ends of the zipper strips 34 and 36 are typically fused together in the regions of the bag side seals, as previously described.

A known slider or clip suitable for use in the two-compartment storage bag shown in FIG. 2 (and other embodiments disclosed herein) may be of the type disclosed in U.S. patent application Ser. No. 10/940,213 entitled "Slider for Operating Zipper of Evacuable Storage Bag". Alternatively, the zippers need not be provided with sliders, in which case the zipper strips can be grasped between a thumb and a forefinger and pressed together along the full length of the zipper.

A known valve assembly suitable for use in the two-compartment storage bag shown in FIG. 2 (and the variation shown in FIG. 4) may be of the type disclosed in U.S. patent application Ser. No. 10/896,734 entitled "Leakproof One-Way Valve for Use with Vacuum Attachment".

The two-compartment storage bag shown in FIG. 2 can be manufactured on an automated production line. In accordance with one method of manufacture, a first web of bag making material is paid out from a first supply roll and advanced in a machine direction, the paid-out section being under tension and disposed in a plane. The first web has mutually parallel lateral edges. At the same time, a pair of zipper or zipper tapes (each zipper tape comprising a pair of zipper strips interlocked with each other) are paid out from respective supply reels and passed through respective tape inserters that guide the paid-out sections of the zipper tapes to respective positions overlying the respective marginal portions of the paid-out section of the first web. A respective zipper strip of each paid-out section of the respective zipper tapes is then joined to the respective marginal portions of the paid-out section of the first web, e.g., by conduction heat sealing, performed, e.g., during dwell times interleaved with intermittent advances of the zipper tapes and web. The other zipper strip of each paid-out section of the respective zipper tapes is not yet joined to bag making material, but being interlocked with the corresponding sections of the joined zipper strips, is carried by the first web/two zipper tape assembly as it advances to a sealing station where a second web will be joined to the assembly.

The second web of bag making material is paid out from a second supply roll and advanced in a machine direction, the paid-out section being under tension and disposed in a plane. The first second web also has mutually parallel lateral edges. Circular holes are punched in the paid-out sections of the second web, the holes being located where the valve assemblies are to be installed. More specifically, two holes are punched in each of a succession of contiguous sections of the second web, each section having a length equal to the width of the bag shown in FIG. 2, the center of the holes corresponding to the centers of the circular valve assemblies depicted in FIG. 2. In one implementation, the valve assembly (not shown in the drawings) is of the type described in U.S. patent application Se. No. 10/896,734) and comprises a base, a retaining ring, and a valve element. The valve element provides the one-way airflow feature in valve assembly. The valve assembly is mounted to the second web of bag making material such that a flange of the base will be disposed on the inside of the finished storage bag. The base extends through the hole in the second web and is held in place by the retaining ring, which is placed over the base on the other side of the second web and will be disposed outside of the finished bag. A paid-out section of the second web, with valve assemblies carried thereon, is then guided to a position overlying a corresponding paid-out section of the first web having sections of the zipper tapes joined thereto. The marginal portions of the second web are then joined to the respective other zipper strips of corresponding paid-out sections of the respective zipper tapes.

At the same time that the second web is being joined to the zipper tapes (which are in turn already joined to the first web), the second web is being joined to the first web in a central band-shaped zone whose centerline is substantially collinear with the midline of the first web. At any moment in time during machine operation, this central zone of joinder extends along the full length of the portions of the paid-out sections of the first and second webs that are disposed downstream of the sealing station that forms the central zone of joinder.

After both webs have been joined to both zipper tapes, the zipper tapes are thermally crushed or ultrasonically stomped at regular spaced intervals therealong to form joints where zipper strips of the same zipper tape are joined; the first and second webs are cross sealed in transverse band-shaped zones of joinder disposed at regular spaced intervals therealong such that the web cross seals are substantially aligned with the zipper joints; and sliders are inserted at regular spaced intervals along both zipper tapes. Alternatively, the zipper joints can be made before the zipper tapes are attached to the first web or after they have been attached to the first web but before the second web is joined to the zipper tapes. A person skilled in the art will appreciate that the zipper strips could be joined to the respective webs separately and then interlocked when the webs are placed in overlying relationship with the zipper strips of each pair respectively aligned with each other.

Following the completion of all of the foregoing method steps, the work in process consists of a chain of paired compartments, each compartment having a respective section of zipper tape, a respective slider and a respective valve assembly. Typically the webs and the zipper tapes are advanced intermittently, while the operations described above are performed during the dwell times.

At a cutting station, individual two-compartment bags are severed from one another by cutting along a line that bisects each successive cross seal, thereby forming respective side seams on the separated two-compartment bag and the leading two-compartment bag still attached to the work in process. Each severed two-compartment bag comprises a pair of overlapping rectangular sheets of flexible bag making material of a type previously described with reference to the known vacuum bag shown in FIG. 1. These rectangular sheets form the front and rear walls of the two-compartment bag.

Figure 4:
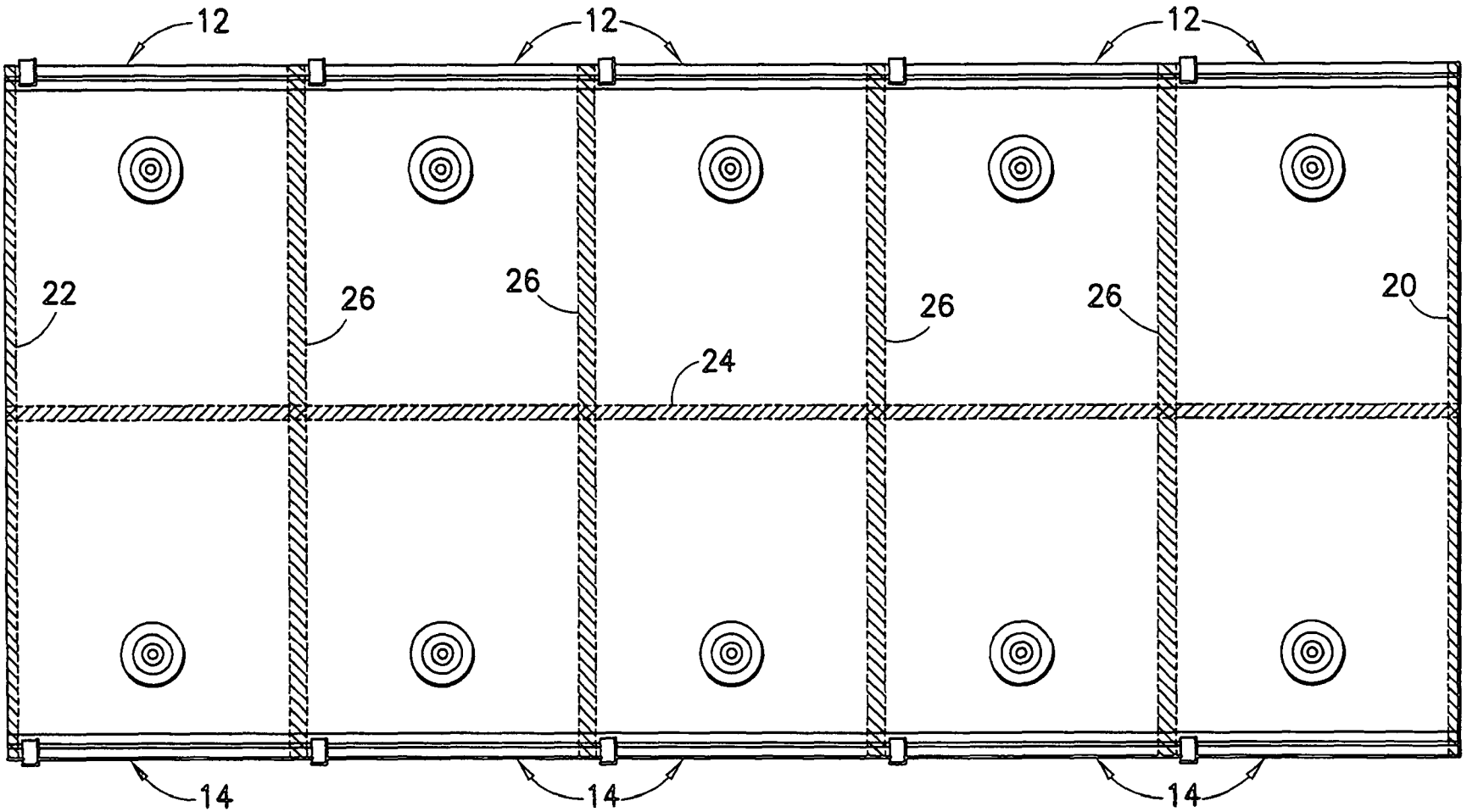
FIG. 4 is a drawing showing a top view of a 10-compartment vacuum storage bag in accordance with one variation of the first embodiment of the invention.

In order to make a succession of two-compartment bags, the cross sealing station operates during each dwell time, as does the cutting station. However, the automated production line can be altered to produce four-compartment, six-compartment, eight-compartment, etc. bags by controlling the cutting station to respectively operate only once every two work cycles, three work cycles, four work cycles and so forth. FIG. 4 shows a variation of the first embodiment having 10 compartments arranged in two rows. A 10-compartment storage bag can be produced by cutting the work in process once every fifth work cycle, each work cycle comprising a respective advancement of the work in process and a respective dwell time. The interior cross seals 26 will have a width twice the width of the side seams 20 and 22, the later being the result of bisecting similar cross seals. The central seal 24, which runs from side seam 20 to side seam 22, divides and connects the two rows of compartments 12 and 14.

Figure 5:
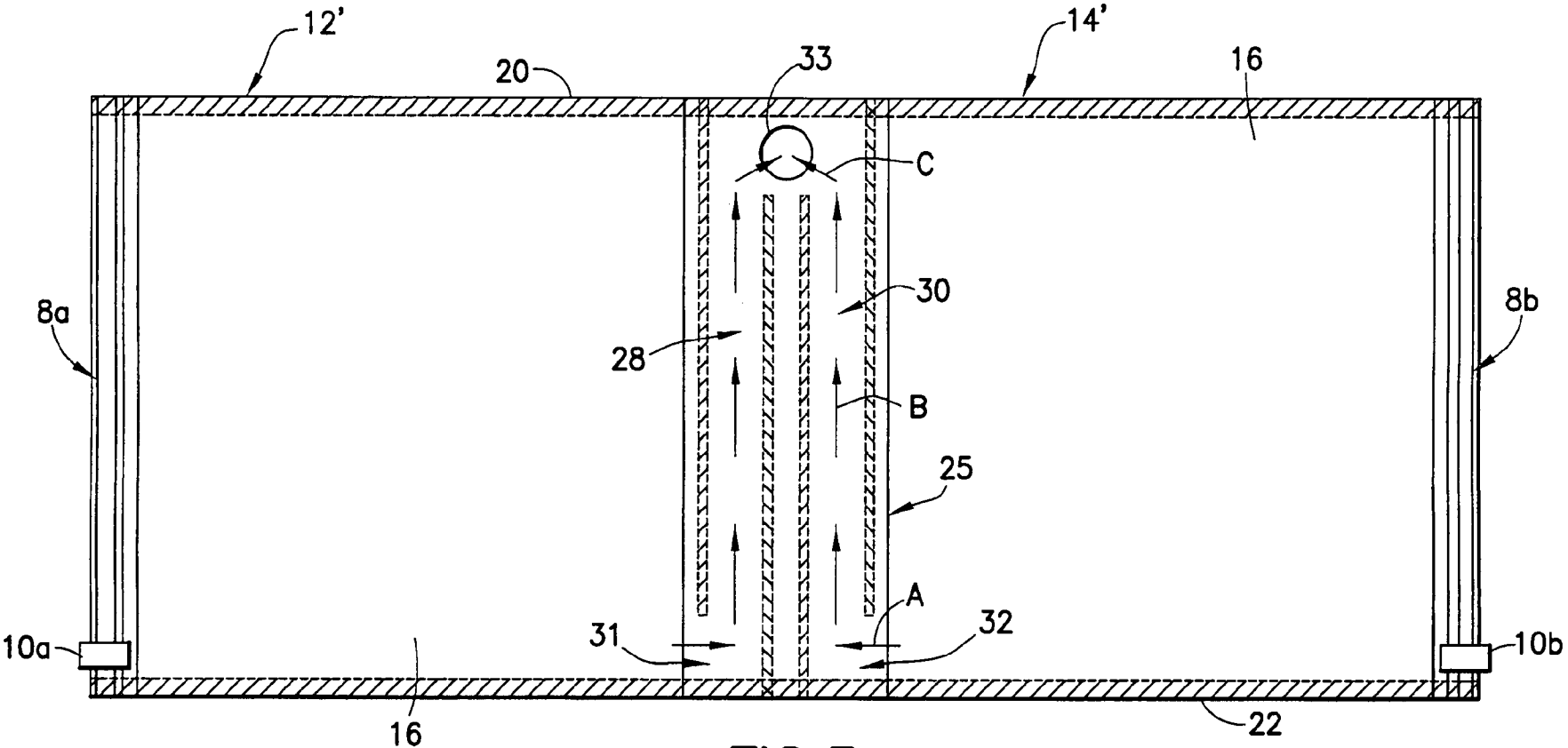
FIG. 5 is a drawing showing a top view of a two-compartment vacuum storage bag in accordance with a second embodiment of the invention.

A two-compartment storage bag in accordance with a second embodiment of the invention is depicted in FIG. 5. The zippers 8*a*, 8*b* and sliders 10*a*, 10*b* may be substantially similar to the corresponding components previously described with reference to FIG. 2. The storage bag shown in FIG. 5 differs from the bag shown in FIG. 2 in that, instead of each compartment being evacuable by means of a respective one-way valve attached to a bag wall, a double valve assembly 25 is installed in a central region that runs parallel to the zippers, the double valve assembly being joined to the bag walls to form the fourth side of each of the two compartments 12' and 14'. The length of the double valve assembly 25 equals the width of the storage bag, with the marginal portions at the respective ends of the double valve assembly 25 being captured and sealed into the respective side seams 20 and 22 of the bag.

Figure 7:
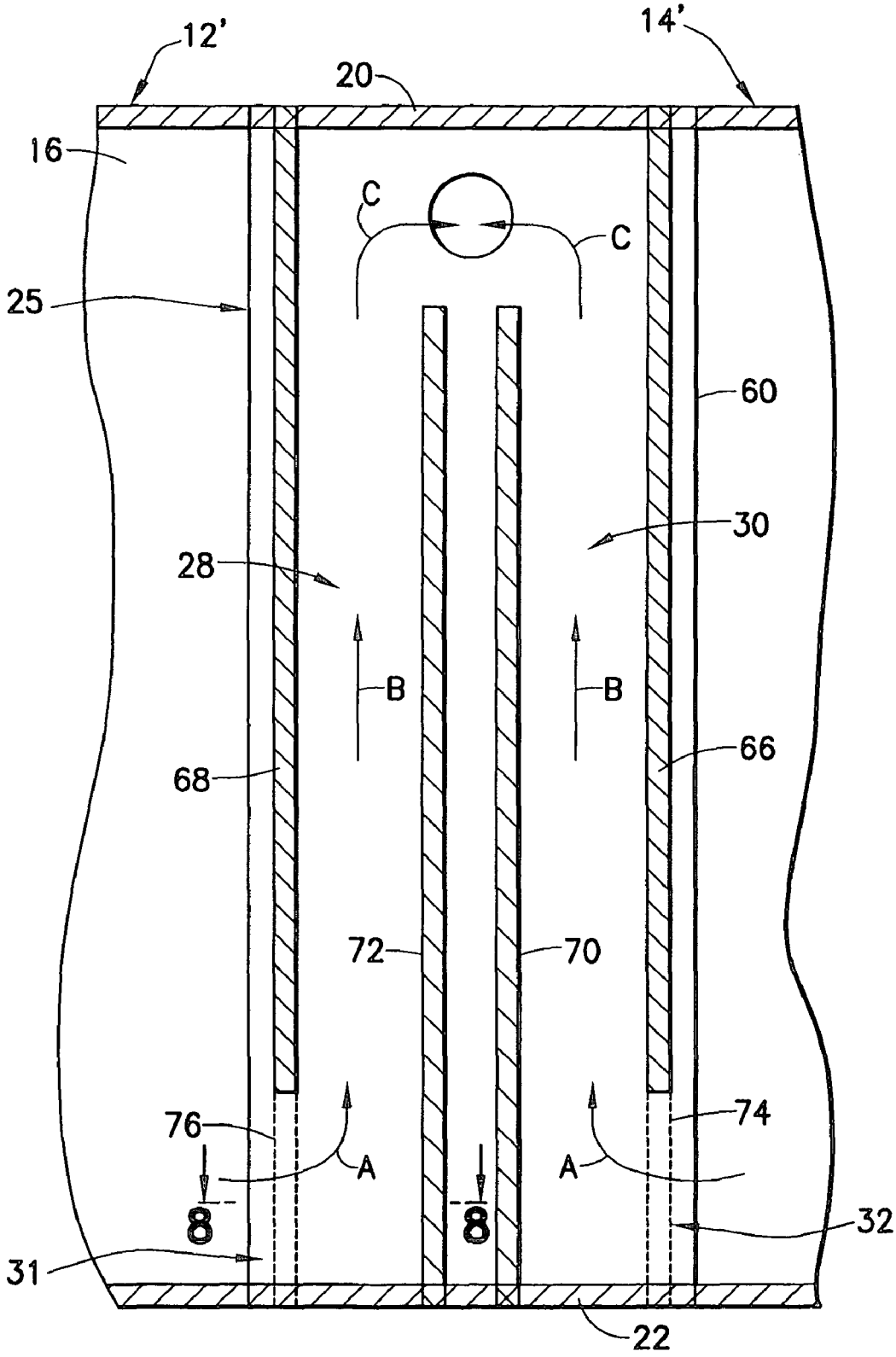
FIG. 7 is a drawing showing a cross-sectional view, partially broken away, of the valve portion of the two-compartment vacuum storage bag shown in FIG. 5.
Figure 8:
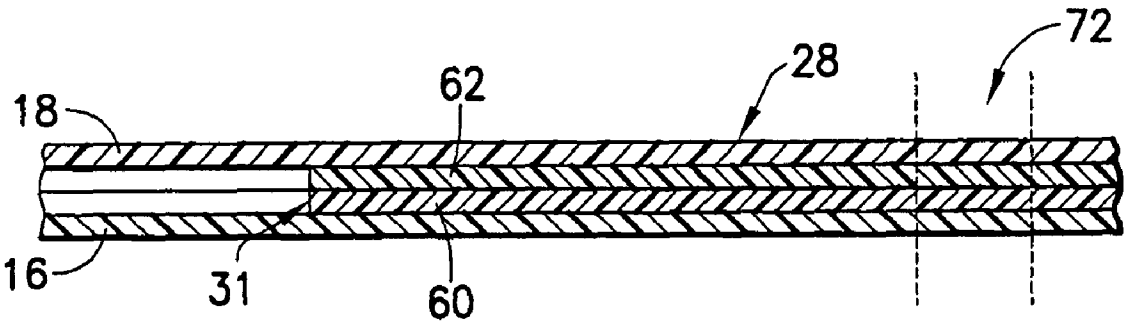
FIG. 8 is a drawing showing a cross-sectional view, the section being taken along line 8-8 indicated in FIG. 7.

As best seen in FIG. 8, the double valve assembly comprises a pair of rectangular strips 60 and 62 of valve making material (hereinafter "valve strips") that are sandwiched between the front and rear walls 16 and 18. The valve strips 60 and 62 are joined to the bag walls 16 and 18 and to each other along the side seams (items 20 and 22 in FIG. 5). The valve strips 60 and 62 are also joined to each other and to the front and rear bag walls 16 and 18 in four band-shaped zones of joinder (indicated by dashed lines bounding solid hatching in FIG. 5) that extend generally parallel to the zippers 8*a*, 8*b*. These four band-shaped zones of joinder 66, 68, 70 and 72 are best seen in FIG. 7, which represents a sectional view of the bag shown in FIG. 5 (the plane of sectioning passing through the zones of bag wall-to-valve strip joinder) with the rear bag wall and the valve strip adjacent the rear bag wall removed.

Referring to FIG. 7, the central sections of the side seams 20 and 22, in combination with the zones of joinder 66, 68, 70 and 72, form a pair of collapsible elongated channels 28 and 30 that extend generally parallel to the zippers. One end of the channel 28 lies adjacent a first valve entry gap 31 disposed on the perimeter of the interior volume of the compartment 12' and extending from and perpendicular to the side seam 22, while the other end of the channel 28 lies adjacent an outlet 33 that is disposed adjacent to the side seam 20. The outlet 33 is formed by overlapping openings in the front bag wall 16 and the adjacent valve strip 60. The channel 30 is the mirror image of the channel 28. More specifically, one end of the channel 30 lies adjacent a second valve entry gap 32 disposed on the perimeter of the interior volume of the compartment 14' and extending from and perpendicular to the side seam 22, while the other end of the channel 30 lies adjacent the outlet 33.

Still referring to FIG. 7, the short band-shaped zone 74 (indicated by dashed lines) represents a zone where the front wall 16 is joined to the valve strip 60. In zone 74, the valve strips are not joined together, but the other valve strip (not shown in FIG. 7) is joined to the rear bag wall. Zone 74 extends from the side seam 22 to the termination point of the zone of joinder 66 and is collinear with the latter. Thus, along the fourth side of compartment 14', the front wall 16 and the valve strip 60 are joined to each other and the rear wall and the other valve strip are joined to each other in a band-shaped zone (consisting of zones 66 and 74) that extends across the full width of the storage bag. In contrast, the valve strips along the fourth side of compartment 14' are joined to each other in zone 66, but not in zone 74, the latter zone demarcating the extent of the valve entry gap 32. Accordingly, air from the interior volume of compartment 14' can enter elongated channel 30 only via the valve entry gap 32.

Similarly, the short band-shaped zone 76 (indicated by dashed lines in FIG. 7) represents a zone where the front wall 16 is joined to the valve strip 60. In zone 76, the valve strips are not joined together, but the other valve strip (not shown in FIG. 7) is joined to the rear bag wall. Zone 76 extends from the side seam 22 to the termination point of the zone of joinder 68 and is collinear with the latter. Thus, along the fourth side of compartment 12', the front wall 16 and the valve strip 60 are joined to each other and the rear wall and the other valve strip are joined to each other in a band-shaped zone (consisting of zones 68 and 76) that extends across the full width of the storage bag. In contrast, the valve strips along the fourth side of compartment 12' are joined to each other in zone 68, but not in zone 76, the latter zone demarcating the extent of the valve entry gap 31. Accordingly, air from the interior volume of compartment 12' can enter elongated channel 28 only via the valve entry gap 31.

Figure 9:
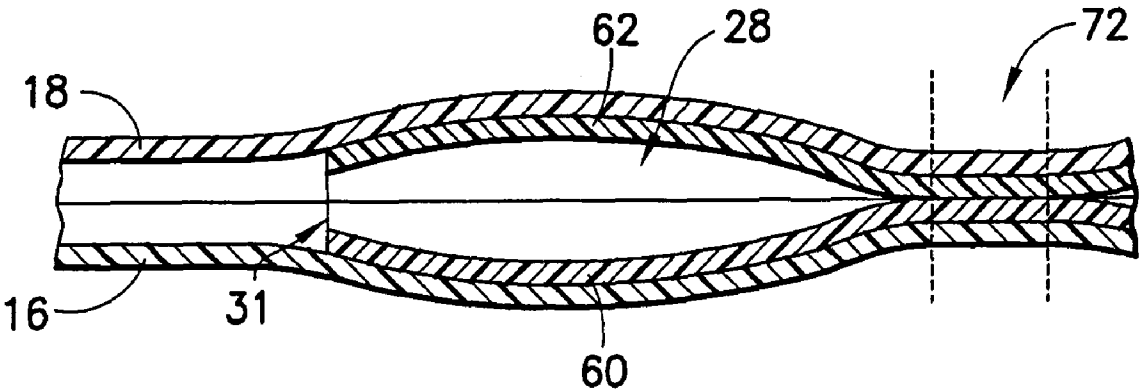
FIG. 9 is a drawing showing a cross-sectional view, similar to FIG. 8, but showing the valve portion of the vacuum storage bag partially filled with air.

FIGS. 8 and 9 are fragmentary sectional views of elongated channel 28, which is shown in a collapsed state (FIG. 8) and a not collapsed state (FIG. 9) respectively. The locations of tacking zone 76 and zone of joinder 72 are indicated by respective pairs of vertical dashed lines in FIG. 9. As previously mentioned, in tacking zone 76 the front wall 16 is tacked to the valve strip 60, the valve strip 60 is not tacked or otherwise joined to valve strip 62, and valve strip 62 is tacked to the rear wall 18. When channel 28 is collapsed (as shown in FIG. 8), air from the interior volume of compartment 12' cannot flow out the outlet 33. Similarly, when channel 30 is collapsed (not shown in the drawings), air from the interior volume of compartment 14' cannot flow out the outlet 33. FIG. 9 shows the situation wherein the elongated channel 28 is not collapsed and the valve entry gap 31 is open. A similar configuration exists when the elongated channel 30 is not collapsed and the valve entry gap 32 is open. When either channel is not collapsed, the corresponding compartment can be evacuated via that channel.

The flow path for exhausting air from the interior volume of compartment 14' is represented by arrows A-C in FIG. 5. Arrow A represents the flow of air from the interior volume of compartment 14', through the valve entry gap 32 and into the elongated channel 30. Arrow B represents the flow of air in the channel 30. Arrow C represents the flow of air from the channel 30 toward and then out the outlet 33. Such an air flow can be produced, e.g., by storing a compressible porous article in the interior volume of compartment 14', closing the zipper **8*b* to hermetically seal the mouth of the compartment 14', and then compressing the article as the compartment 14' is rolled up starting at the zipper 8*b*. The resulting air pressure causes the valve entry gap 32 and then the elongated channel 30 to open as air is squeezed out of the compartment 14'. When the compartment 14' is no longer being squeezed, the elongated channel 30 will again collapse due to ambient pressure, forming a hermetic seal that prevents air from re-entering the compartment 14' via the outlet 33**.

As disclosed in U.S. Pat. No. 6,729,473, the valve strips are preferably made of a material that is smoother than the bag wall material. Such materials include, but are not limited to, low-density polyethylene (LDPE), linear low-density polyethylene (LLDPE) or polyethylene/EVOH/polyethylene. The valve strips preferably each have a thickness of 2 mils, for a combined thickness of 4 mils. This thickness for the valve strips was found to provide the valve strips with sufficient stiffness to avoid conforming entirely to the adjacent bag wall films, and yet allow the valve strips to conform to some extent to one another, such that the valve strips sealingly close in the absence of pressure on the walls of the bag.

Air being evacuated from the storage bag travels between the two valve strips, and not between either the front bag wall and confronting valve strip or the rear bag wall and confronting valve strip. Since the valve strips are smooth, regardless of any texture imparted to the bag walls, a more reliable seal of the valve is obtained. When no pressure is physically exerted on the walls of the compartments, ambient atmospheric pressure is sufficient to press valve strips together, thereby impeding unwanted air from entering the elongated channels and the compartments respectively associated therewith. Due to the length of each elongated channel and the somewhat tortuous path therethrough that air would need to take to re-enter the compartments, when no pressure is exerted on the bag walls, atmospheric pressure is sufficient to keep the bag walls pressed together on the outside of the elongated channels, which in turn presses the valve strips together, thereby sealing the valves, as shown in FIG. 8.

In accordance with one method of manufacturing evacuable storage bags of the type shown in FIG. 5, first and second substantially identical strips of valve making film are respectively paid out from first and second valve film supply rolls, while first and second substantially identical webs of bag making film are respectively paid out from first and second bag film supply rolls. As disclosed in U.S. Pat. No. 6,729,473, the valve making film may be smooth compared to the relatively rough surface of the bag making film. The respective widths of the valve strips and bag webs can be seen in FIG. 5, wherein the width of the valve assembly 25 corresponds to the width of each valve strip, while the full height of the front wall 16 measured in a direction perpendicular to the zippers corresponds to the width of each web of bag making film. The first valve strip and first bag web are guided to respective positions in immediate proximity to each other and with their respective centerlines overlapping. Similarly, the second valve strip and second bag web are guided to respective positions in immediate proximity to each other and with their respective centerlines overlapping. The first valve strip and first bag web travel intermittently and concurrently to a first valve film tacking station at which a first pair of tacking heads seal two elongated band-shaped portions of the first valve strip to corresponding portions of the first bag web during each dwell time (hereinafter referred to as "first and second tack seals"). At the same time, a hole can be punched in both the first bag web and first valve strip that will ultimately become the outlet 33 shown in FIG. 7. Similarly, the second valve strip and second bag web travel intermittently and concurrently to a second valve film tacking station at which a second pair of tacking heads seal two elongated band-shaped portions of the second valve strip to corresponding portions of the second bag web during each dwell time (hereinafter referred to as "third and fourth tack seals"). The four tack seals have the same length and width and all extend in the machine direction. The footprint of the first and second tack seals is substantially identical to the footprint of the third and fourth tack seals, so that when the respective tacked constructions are aligned with the first and second valve strips confronting each other, the first tack seal overlies the third tack seal, while the second tack seal overlies the fourth tack seal.

The respective tacked constructions are then advanced intermittently toward a dual zipper application station. During this advancement, the webs of bag film are aligned and brought together in overlapping relationship with the valve strips facing and in contact with each other. At the same time, a pair of substantially identical zipper tapes each zipper tape comprising a respective pair of interlocked zipper strips are paid out from first and second zipper tape supply reels respectively and guided into respective positions sandwiched between the respective marginal portions of the overlapping bag webs. In accordance with one embodiment, the dual zipper application station comprises two pairs of mutually opposing, reciprocatable heated sealing bars that join the zipper tapes to the bag webs by conductive heat sealing. The amount of heat and pressure applied to the zipper tapes and marginal portions of the bag webs must be sufficient to cause the bag making film (or a sealant layer thereof in the case of a laminated film), to soften or melt and then fuse to the contacting zipper strip during cooling, but not so great as to cause the closure profiles of the zipper strips to fuse together. Alternative methods of zipper/web joinder can be utilized, such as adhesive application or ultrasonic welding.

The section of the work in process that exits the dual zipper application station consists of the first and second bag webs in overlapping relationship, the left marginal portions of the first and second bag webs being joined to a first zipper tape situated therebetween, the right marginal portions of the first and second bag webs being joined to a second zipper tape situated therebetween, the first valve strip being tacked to a central portion of the first web and carried thereby, and the second valve strip being tacked to a central portion of the second web and carried thereby. This section of the work in process is then advanced intermittently to a dual ultrasonic welding station, where the zipper tapes are ultrasonically welded together to form respective zipper joints during each dwell time. Zipper joints are made at regular spaced intervals along the length of the zipper tapes, one zipper joint per package-width section of zipper tape. In the discrete areas where ultrasonic welding occurs, the closure profiles of the zipper tape are flattened. The ultrasonic welding station may comprise an ultrasonic horn and an anvil, one or both of which is reciprocatable.

Preferably after zipper joinder, sliders can be inserted on the zippers in a manner well known in the art.

The particular section of the work in process under discussion is then advanced intermittently to a cross sealing station, where a respective cross seal (see, e.g., cross seals 26 in FIG. 6) is formed during each dwell time. Again the cross sealing station may comprise a pair of mutually opposing, reciprocatable heated sealing bars that join the materials pressed therebetween when zipper tapes to the bag webs by conductive heat sealing. The cross sealing bars extend transversely across the full width of the bag webs. The cross sealing station is in registration with the ultrasonic welding station, so that each cross seal is aligned with and overlaps a respective zipper joint.

At the next station, four sets of mutually confronting, reciprocatable heated sealing bars (all disposed parallel to the machine direction) are pressed against the central section of the work in process, i.e., where the valve strips are located. The two inner sets of sealing bars are aligned with each other, but staggered relative to the two outer sets of sealing bars, which are likewise aligned with each other. During each dwell time, these heated sealing bars are extended for a duration of time sufficient to form the zones of joinder 66, 68, 70 and 72 (seen in FIG. 7) for one storage bag. In each of these zones of joinder, the front and rear bag walls and both valve strips are sealed together. These sealing bars are staggered such that when the tacked bag web/valve strip construction is in proper registration, the sealing bars do not contact the zones of tack sealing, thereby ensuring that the valve strips in the tacking zones are not joined together and that the valve entry gaps are preserved.

Following the completion of all of the foregoing method steps, the work in process consists of a chain of storage bags, each storage bag comprising a respective double valve assembly of the type shown in FIG. 7, with successive storage bags in the chain being connected by a respective cross seal. At a cutting station, individual two-compartment bags are severed from one another by cutting along a line that bisects each successive cross seal, thereby forming respective side seams on the separated two-compartment bag and the leading two-compartment bag still attached to the work in process. Each severed two-compartment bag comprises a pair of overlapping rectangular sheets of flexible bag making material of a type previously described. These rectangular sheets form the front and rear walls of the two-compartment bag.

Figure 6:
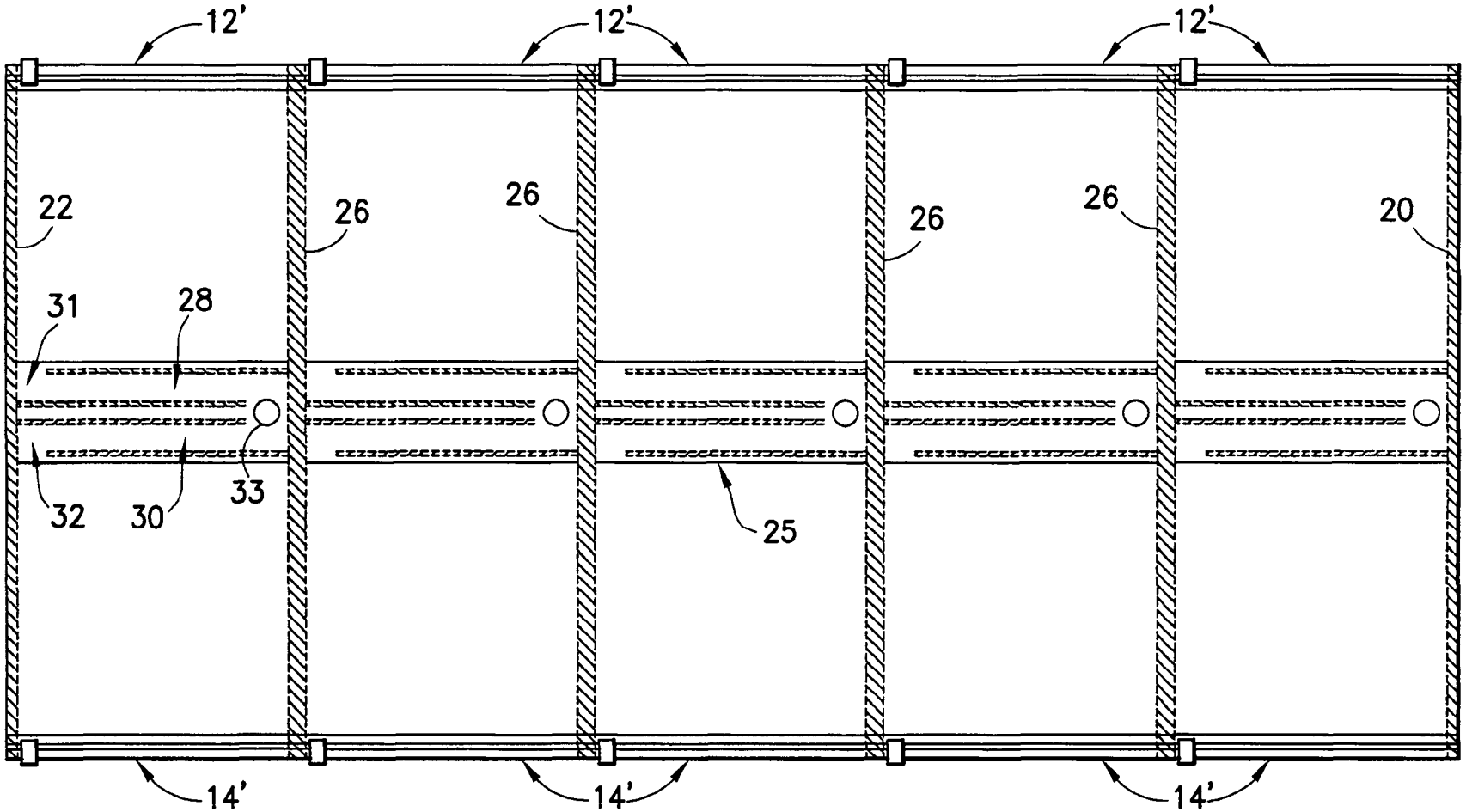
FIG. 6 is a drawing showing a top view of a 10-compartment vacuum storage bag in accordance with one variation of the second embodiment of the invention.

In order to make a succession of two-compartment bags, the cross sealing station operates during each dwell time, as does the cutting station. However, the automated production line can be altered to produce four-compartment, six-compartment, eight-compartment, etc. bags by controlling the cutting station to respectively operate only once every two work cycles, three work cycles, four work cycles and so forth. FIG. 6 shows a variation of the second embodiment having 10 compartments arranged in two rows. A 10-compartment storage bag can be produced by cutting the work in process once every fifth work cycle, each work cycle comprising a respective advancement of the work in process and a respective dwell time. The interior cross seals 26 will have a width twice the width of the side seams 20 and 22, the latter being the result of bisecting similar cross seals.

While the invention has been described with reference to various embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, welded, bonded, sealed, adhered, etc., whether by application of heat and/or pressure, application of ultrasonic energy, application of a layer of adhesive material or bonding agent, interposition of an adhesive or bonding strip, co-extrusion (e.g., of zipper and bag), etc. As used in the claims, the prefix "multi" means two or more. Further, in the absence of explicit language in any method claim setting forth the order in which certain steps should be performed, the method claims should not be construed to require that steps be performed in the order in which they are recited.

The invention claimed is:

1. A compartmented storage bag comprising first and second zippered compartments connected to a double valve assembly therebetween, said double valve assembly comprising first and second valve entry gaps, first and second collapsible channels and an outlet, an interior space of said first compartment being in flow communication with the ambient atmosphere via said first valve entry gap, said first collapsible channel and said outlet when said first valve entry gap and said first collapsible channel are open and said first zipper is closed, and being not in flow communication with the ambient atmosphere when said first collapsible channel and said first zipper are closed, and an interior space of said second compartment being in flow communication with the ambient atmosphere via said second valve entry gap, said second collapsible channel and said outlet when said second valve entry gap and said second collapsible channel are open and said second zipper is closed, and being not in flow communication with the ambient atmosphere when said second collapsible channel and said second zipper are closed, wherein said double valve assembly comprises first and second valve strips which are joined together to form said first and second valve entry gaps and said first and second collapsible channels, and wherein said outlet comprises an opening formed in said first valve strip.

2. The compartmented storage bag as recited in claim 1, wherein each of said first and second zippered compartments comprises front and rear walls, and said first and second valve strips are made of a material that is smoother than the material of said front and rear walls.

3. The compartmented storage bag as recited in claim 2, wherein said first and second collapsible channels are mutually parallel.

4. A compartmented storage bag comprising first and second sheets of thin flexible material that extend from a first side seam to a second side seam, a first plastic zipper that extends from said first side seam to said second side seam and is joined to first marginal portions of said first and second sheets, a second plastic zipper that extends from said first side seam to said second side seam and is joined to second marginal portions of said first and second sheets, said first and second zippers being generally parallel when said first and second sheets are arranged in a planar configuration, and first and second valve strips that extend from said first side seam to said second side seam in a region located between said first and second zippers, said first and second valve strips being sandwiched between said first and second sheets and being joined to each other and to said first and second sheets in the areas where said first and second side seams overlap with said first and second valve strips and in first and second zones of joinder which extend from said first side seam toward but short of said second side seam, the ends of said first and second zones of joinder being separated from said second side seam by first and second valve entry gaps respectively, said first valve strip being joined to said first sheet along said first and second valve entry gaps, said second valve strip being joined to said second sheet along said first and second valve entry gaps, and said first and second valve strips being not joined to each other along said first and second valve entry gaps, and said first and second valve strips being further joined to each other in a third zone of joinder which is located between said first and second zones of joinder and extends from said second side seam toward but short of said first side seam, said first and second valve strips being separable in a region between said first and third zones of joinder for forming a first collapsible channel, further comprising overlapping openings in said first sheet and said first valve strip, said overlapping openings being disposed in a region that extends between said first side seam and an end of said third zone of joinder.

5. The compartmented storage bag as recited in claim 4, wherein said first and second valve strips are further joined to each other in a fourth zone of joinder which is located between said second and third zones of joinder and extends from said second side seam toward but short of said first side seam, said first and second valve strips being separable in a region between said second and fourth zones of joinder for forming a second collapsible channel, wherein said region in which said overlapping openings are disposed extends between said first side seam and an end of said fourth zone of joinder.

6. The compartmented storage bag as recited in claim 5, wherein a first space between respective portions of said first and second sheets and bounded by said first and second side seams, said first zipper and said first zone of joinder will be in flow communication with said overlapping openings when said first valve entry gap and said first collapsible channel are open, and will not be in flow communication with said overlapping openings when said first valve entry gap and said first collapsible channel are closed, and a second space between respective portions of said first and second sheets and bounded by said first and second side seams, said second zipper and said second zone of joinder will be in flow communication with said overlapping openings when said second valve entry gap and said second collapsible channel are open, and will not be in flow communication with said overlapping openings when said second valve entry gap and said second collapsible channel are closed.

7. The compartmented storage bag as recited in claim 5, wherein said first and second collapsible channels are mutually parallel.

8. The compartmented storage bag as recited in claim 4, wherein a first space between respective portions of said first and second sheets and bounded by said first and second side seams, said first zipper and said first zone of joinder will be in flow communication with said overlapping openings when said first valve entry gap and said first collapsible channel are open, and will not be in flow communication with said overlapping openings when said first valve entry gap and said first collapsible channel are closed.

9. The compartmented storage bag as recited in claim 4, further comprising a first slider mounted to said first zipper and designed to close any open section of said first zipper that said first slider overrides during travel of said first slider along said first zipper in either direction, and a second slider mounted to said second zipper and designed to close any open section of said second zipper that said second slider overrides during travel of said second slider along said second zipper in either direction.

10. The compartmented storage bag as recited in claim 4, wherein said first and second valve strips are made of a material that is smoother than the material of said first and second sheets.

* * * * *